US009278264B2

(12) United States Patent
Stokke et al.

(10) Patent No.: US 9,278,264 B2
(45) **Date of Patent: *Mar. 8, 2016**

(54) GOLF CLUB HEADS WITH LOFT-BASED WEIGHTS AND METHODS TO MANUFACTURE GOLF CLUB HEADS

(71) Applicant: Karsten Manufacturing Corporation, Phoenix, AZ (US)

(72) Inventors: Ryan Stokke, Phoenix, AZ (US); Marty R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 143 days.

This patent is subject to a terminal disclaimer.

(21) Appl. No.: 13/725,162

(22) Filed: Dec. 21, 2012

(65) Prior Publication Data

US 2013/0109487 A1 May 2, 2013

Related U.S. Application Data

(60) Continuation-in-part of application No. 12/822,858, filed on Jun. 24, 2010, now Pat. No. 8,342,980, which is a division of application No. 12/178,795, filed on Jul. 24, 2008, now abandoned.

(51) Int. Cl.
*A63B 53/04* (2015.01)
*A63B 53/00* (2015.01)

(52) U.S. Cl.
CPC ..... *A63B 53/04* (2013.01); *A63B 53/0466* (2013.01); *A63B 53/047* (2013.01); *A63B 2053/005* (2013.01); *A63B 2053/0408* (2013.01); *A63B 2053/0433* (2013.01); *A63B 2053/0458* (2013.01); *A63B 2053/0462* (2013.01); *A63B 2053/0491* (2013.01); *Y10T 29/49826* (2015.01)

(58) Field of Classification Search
CPC ..... A63B 53/04; A63B 53/0466; A63B 2053/0433; A63B 2053/0491; A63B 53/047; A63B 2053/0408; A63B 2053/0462; A63B 2053/0458; Y10T 29/49826
USPC ..... 473/290–291
See application file for complete search history.

(56) References Cited

U.S. PATENT DOCUMENTS

| | | | | |
|---|---|---|---|---|
| 3,980,301 | A | 9/1976 | Smith | |
| 4,322,083 | A | 3/1982 | Imai | |
| 4,420,156 | A | 12/1983 | Campau | |
| 4,840,380 | A | 6/1989 | Kajita et al. | |
| 4,874,171 | A | 10/1989 | Ezaki et al. | |
| 5,094,457 | A | 3/1992 | Kinoshita | |
| 5,643,107 | A | 7/1997 | Gorman | |
| 5,851,160 | A | 12/1998 | Rugge et al. | |
| 5,908,356 | A | 6/1999 | Nagamoto | |
| 5,935,020 | A * | 8/1999 | Stites et al. | 473/345 |
| 6,074,310 | A | 6/2000 | Ota | |
| 6,315,678 | B1 | 11/2001 | Teramoto | |
| 6,340,337 | B2 * | 1/2002 | Hasebe et al. | 473/349 |

(Continued)

FOREIGN PATENT DOCUMENTS

| | | | |
|---|---|---|---|
| JP | 2000300701 | 4/1999 | |
| JP | 2000-300701 | * 10/2000 | |
| JP | 2001231888 A | * 8/2001 | A63B 53/00 |

*Primary Examiner* — Stephen Blau

(57) ABSTRACT

Embodiments of golf club heads with loft-based weights and methods to manufacture golf club heads are generally described herein. Other embodiments may be described and claimed.

8 Claims, 10 Drawing Sheets

(56) References Cited

U.S. PATENT DOCUMENTS

| | | | | |
|---|---|---|---|---|
| 6,368,234 | B1 * | 4/2002 | Galloway | 473/349 |
| 6,398,666 | B1 * | 6/2002 | Evans et al. | 473/345 |
| 6,434,811 | B1 | 8/2002 | Helmstetter et al. | |
| 6,494,790 | B1 | 12/2002 | Toyota et al. | |
| 6,530,846 | B1 * | 3/2003 | Mase | 473/290 |
| 6,599,202 | B2 * | 7/2003 | Miyamoto | 473/289 |
| 6,776,723 | B2 | 8/2004 | Bliss et al. | |
| 6,852,038 | B2 | 2/2005 | Yabu | |
| 6,945,877 | B2 | 9/2005 | Kobayashi et al. | |
| 6,984,180 | B2 * | 1/2006 | Hasebe | 473/291 |
| 7,147,571 | B2 | 12/2006 | Best et al. | |
| 7,153,220 | B2 | 12/2006 | Lo | |
| 7,556,571 | B2 | 7/2009 | Adams | |
| 7,887,434 | B2 | 2/2011 | Beach et al. | |
| 7,938,736 | B2 | 5/2011 | Park et al. | |
| 2002/0055391 | A1 | 5/2002 | Teramoto | |
| 2004/0002395 | A1 | 1/2004 | Poynor | |
| 2007/0049405 | A1 | 3/2007 | Tateno et al. | |
| 2007/0117651 | A1 | 5/2007 | Belmont | |
| 2008/0058113 | A1 | 3/2008 | Nicolette et al. | |
| 2008/0132356 | A1 | 6/2008 | Chao et al. | |
| 2008/0161124 | A1 | 7/2008 | Kajita | |
| 2008/0227565 | A1 * | 9/2008 | Ban | 473/343 |

* cited by examiner

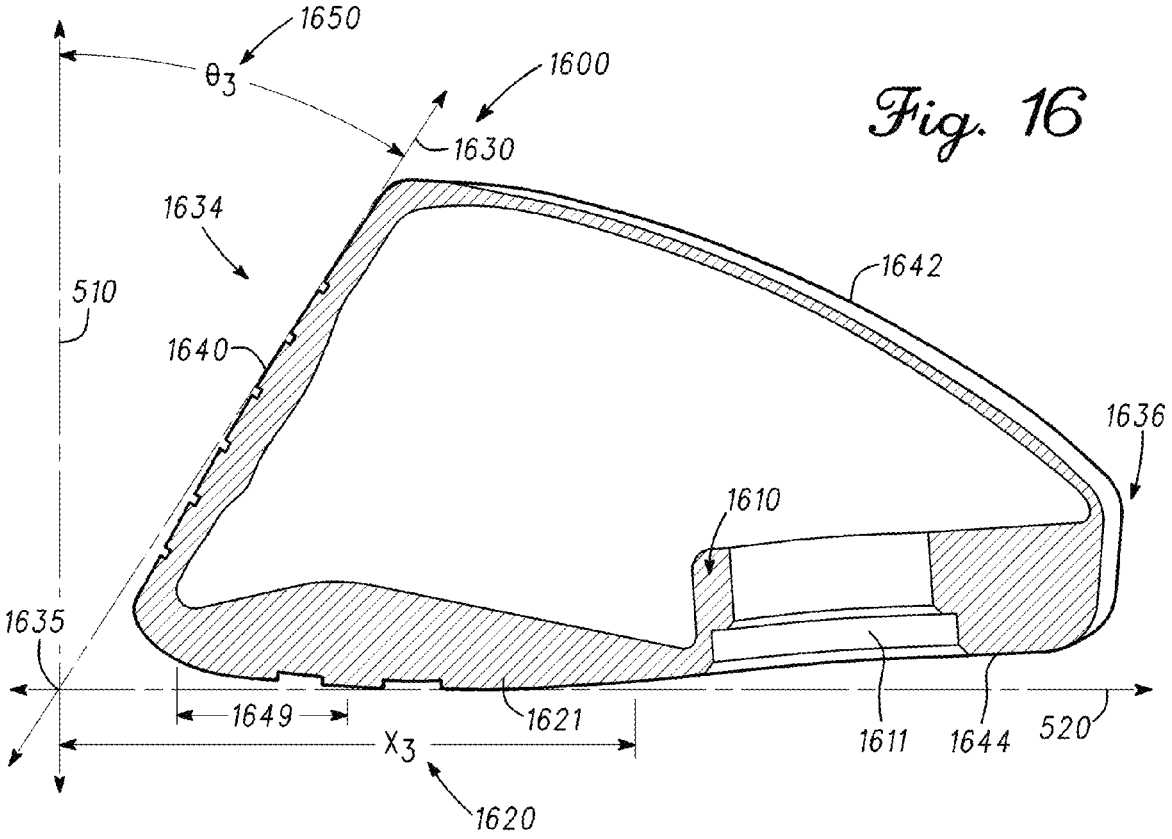
Fig. 16
Fig. 17
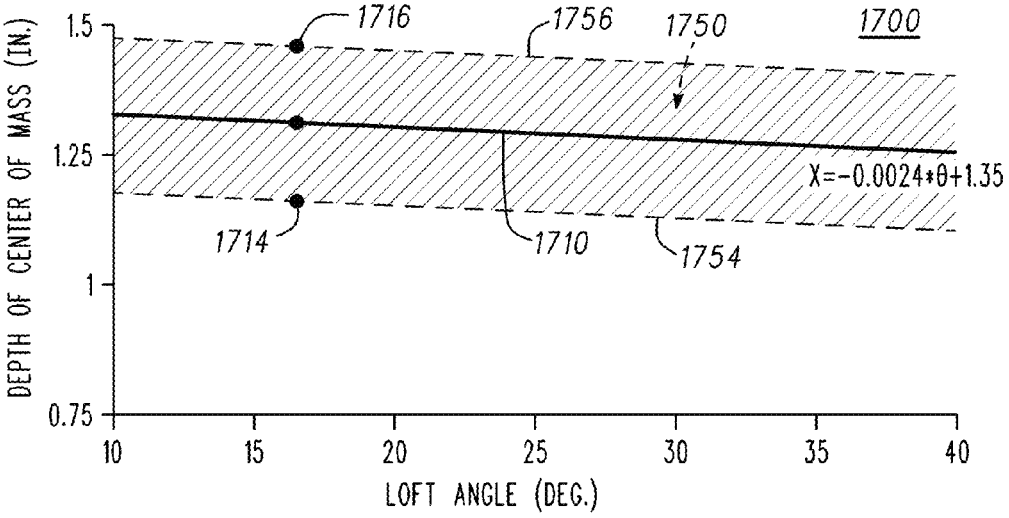

GOLF CLUB HEADS WITH LOFT-BASED WEIGHTS AND METHODS TO MANUFACTURE GOLF CLUB HEADS

TECHNICAL FIELD

The present disclosure relates generally to golf equipment, and more particularly, to golf club heads with loft-based weights and methods to manufacture golf club heads.

BACKGROUND

Typically during a golf shot, energy may be transferred from the club head of a golf club to the golf ball. Several factors including initial velocity, backspin rate, and launch angle may affect the flight of the golf ball (i.e., ball flight). In addition to club head speed, club head shape and structure may affect the initial velocity, the spin rate, and/or the launch angle of the golf ball. The initial velocity of the golf ball may be a function of the club head speed at impact between the club head and the golf ball. With all other factors held constant, a higher initial ball velocity may result in the golf ball traveling farther.

The physical geometry and structure of the club head may define a loft angle (e.g., club loft). In particular, the loft angle may be an angle between a front end plane and a loft plane (e.g., a plane parallel to the club face). When the club head impacts the golf ball, spin may be imparted on the golf ball. Ball flight and flight distance of the golf ball may vary based on the spin imparted by the club head. For example, a club head with a relatively higher loft angle may impart a relatively higher ball flight but may provide a relatively shorter flight distance. In contrast, a club head with a relatively lower loft angle may provide a relatively farther flight distance but impart a relatively lower ball flight. Thus, a set of golf clubs may include a progression of loft angles to provide an individual with a range of ball flights and flight distances.

BRIEF DESCRIPTION OF THE DRAWINGS

FIG. 16 depicts a cross-sectional view of a further example golf club head, according to the second embodiment.

FIG. 17 illustrates a graph of an exemplary relationship between loft angle and the depth of center of mass of a golf club head, according to the second embodiment.

DESCRIPTION

Figure 1:
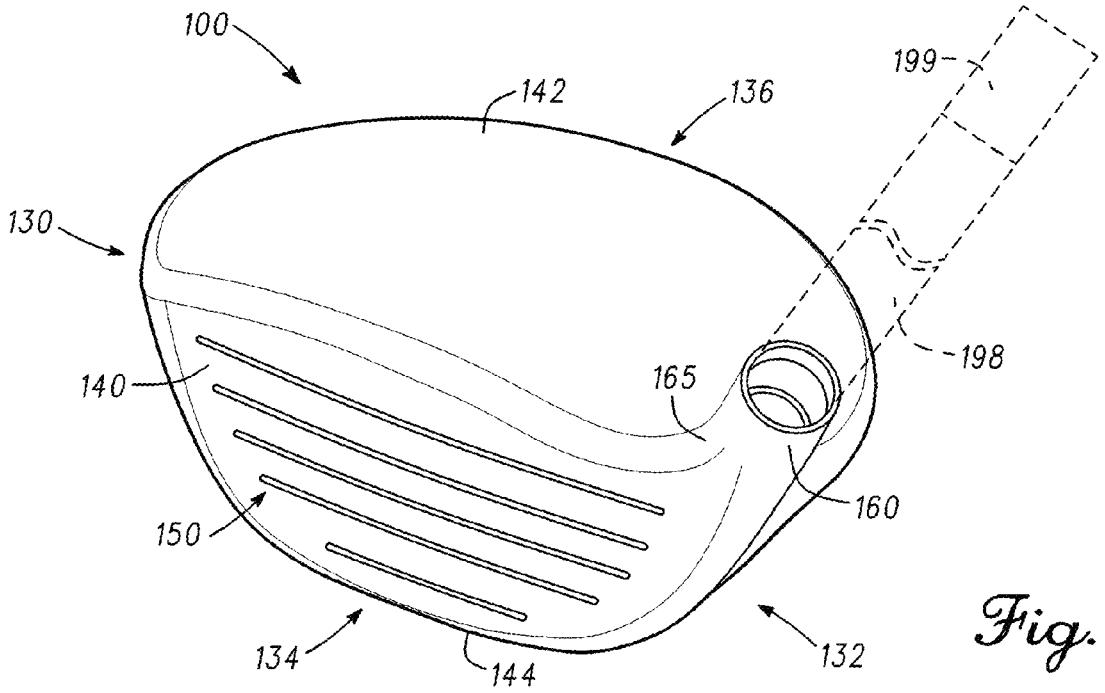
FIG. 1 is a top perspective view of an example golf club head according to an embodiment of the apparatus, methods, and articles of manufacture described herein.

In some embodiments, a set of golf clubs can include: at least two golf clubs, each club of the at least two golf clubs can have: a grip; a shaft having a first end and a second end, the shaft coupled to the grip at the first end; and a club head having a toe end, a heel end, a front end, a back end, a top wall portion, a bottom wall portion, and a face portion associated with a loft angle, the loft angle defined by a loft plane and a front end plane perpendicular to a ground plane, the loft plane substantially parallel to the face portion, the front end plane located at a front-most part of the face portion; and a first weight, a center of mass of the first weight positioned at or proximate to a first distance between the front end plane, at least a portion of the first weight positioned along an axis extending between the front end and the back end. The center of mass of the first weight is the center of mass for each club head of the at least two golf clubs. The first distance of each club of the at least two golf clubs is defined by an equation of $((-0.0024*\theta)+1.28)\geq x\geq((-0.0024*\theta)+0.98)$ where the first distance, x, has units of inches and the loft angle, θ, has units of degrees. Each of the at least two golf clubs has a different loft angle and a different first distance.

In other embodiments, a set of golf clubs can include two or more golf club heads. Each club head of the two or more golf club heads have: a body having a front face. A center of mass of each club head of the two or more golf club heads is positioned at a first distance relative to a front end plane, the front end plane is located at the front face and is perpendicular to a ground plane. The front face of each club head of the two or more golf club heads has a loft angle, the loft angle is an angle between the front face and the front end plane. The first distance, x, is defined by an equation of $((-0.0005*\theta)+1.5)\geq x\geq((-0.0300*\theta)+1.2)$, where the first distance, x, has units of inches and the loft angle, θ, has units of degrees and each of the two or more golf clubs has a different loft angle and a different first distance.

In various embodiments, a set of golf clubs can include: a first club having a first club head, the first club head comprising: a first toe end, a first heel end, a first front end, a first back end, a first top wall portion, a first bottom wall portion, a first face portion associated with a first loft angle defined by a first loft plane and a first front end plane, the first front end plane is perpendicular to a first ground plane, and a first weight, at least a portion of the first weight positioned along a first axis extending between the first front end and the first back end;

and a second club having a second club head, the second club head having a second toe end, a second heel end, a second front end, a second back end, a second top wall portion, a second bottom wall portion, a second face portion associated with a second loft angle defined by a second loft plane and a second front end plane, the second front end plane is perpendicular to the first ground plane, and a second weight, at least a portion of the second weight positioned along a second axis extending between the second front end and the second back end. A first center of mass of the first club is positioned at or proximate to a first distance relative to the first front end plane. A second center of mass of the second club is positioned at or proximate to a second distance relative to the second front end plane. A first height is defined as a third distance between the first center of mass of the first club and the first bottom wall portion of the first club. A second height is defined as a fourth distance between the second center of mass of the second club and the second bottom wall portion of the second club. The first loft angle is greater than the second loft angle. The first distance is less than the second distance and the first height is less than the second height.

In still other embodiments, a set of golf clubs can include two or more golf club heads. Each club head of the two or more golf club heads comprises: a body having a front face. A center of mass of each club head of the two or more golf club heads is positioned at a first distance relative to a front end plane, the front end plane is located at the front face and is perpendicular to a ground plane. The front face of each club head of the two or more golf club heads has a loft angle, the loft angle is an angle between the front face and the front end plane. The first distance of each club head of the two or more golf club heads is inversely proportional to the loft angle of the front face of each club head of the two or more golf club heads. The first distance, x, is defined by an equation of $((0.0001*\theta^2)+(-0.0081*\theta)+1.35)\geq x\geq((0.0001*\theta^2)+(-0.0081*\theta)+1.05)$, where the first distance, x, has units of inches and the loft angle, θ, has units of degrees and each of the two or more golf clubs has a different loft angle and a different first distance.

In further embodiments, a method of manufacturing a set of golf clubs wherein the method can include providing first a club head, the first club head comprising: a first toe end, a first heel end, a first front end, a first back end, a first top wall portion, a first bottom wall portion, a first face portion associated with a first loft angle defined by a first loft plane and a first front end plane, the first front end plane is perpendicular to a first ground plane, and a first weight, a first center of mass of the first club head is positioned at or proximate to a first distance relative to the first front end plane, at least a portion of the first weight positioned along a first axis extending between the first front end and the first back end; providing a first shaft having a first end and a second end; coupling the first end of the first shaft to the first club head; providing a first grip; coupling the first grip to the first shaft at the second end of the first shaft; providing a second club having a second club head, the second club head having a second toe end, a second heel end, a second front end, a second back end, a second top wall portion, a second bottom wall portion, a second face portion associated with a second loft angle defined by a second loft plane and a second front end plane, the second front end plane is perpendicular to the first ground plane, and a second weight, a second center of mass of the second club head is positioned at or proximate to a second distance relative to the second front end plane, at least a portion of the second weight positioned along a second axis extending between the second front end and the second back end; providing a second shaft having a first end and a second end; coupling the first end of the second shaft to the second club head; providing a second grip; and coupling the second grip to the second shaft at the second end of the second shaft. The first distance is defined by a first equation of $((-0.0005*\theta)+1.5)\geq x\geq((-0.0300*\theta)+1.2)$, where the first distance, x, has units of inches and the first loft angle, θ, has units of degrees. The second distance is defined by a second equation of $((-0.0005*\alpha)+1.5)\geq y\geq((-0.0300*\alpha)+1.2)$, where the second distance, y, has units of inches and the second loft angle, α, has units of degrees. The second distance is different from the first distance. The second loft angle is different from the first loft angle.

In general, apparatus, methods, and articles of manufacture associated with golf club heads with loft-based weights are described herein. The methods, apparatus, and articles of manufacture described herein are not limited in this regard.

Figure 2:
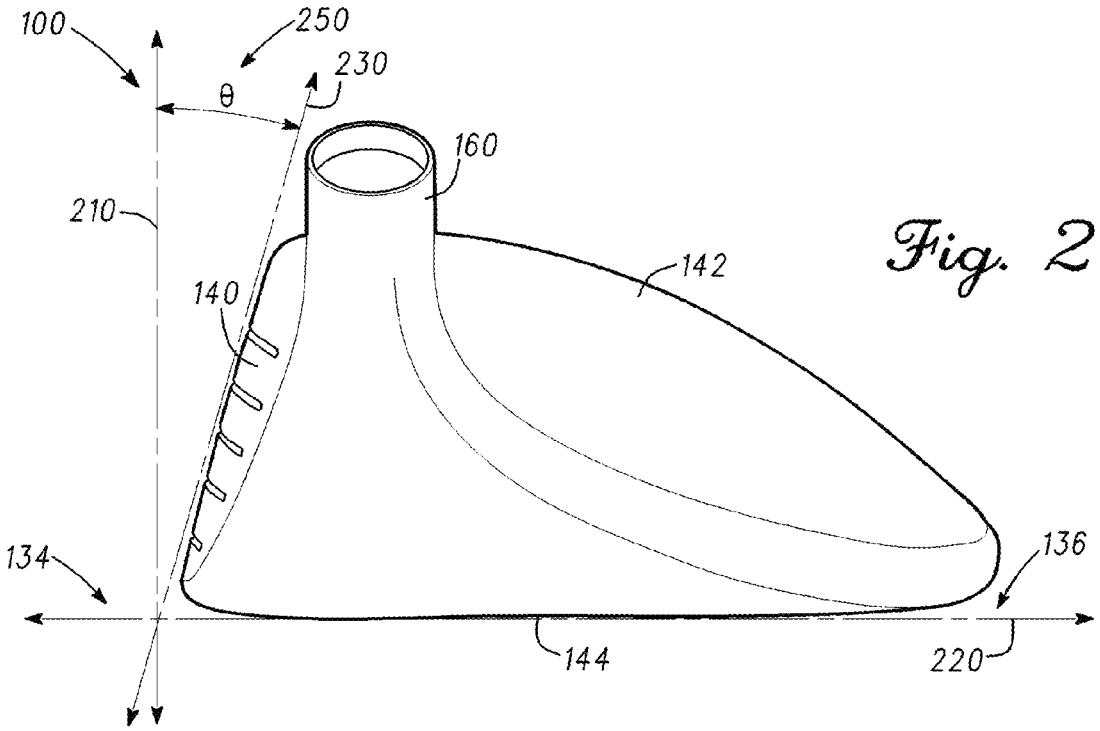
FIG. 2 depicts a heel end view of the example golf club head of FIG. 1.

FIGS. 1 and 2 depict an example golf club head 100 that may include a toe end 130, a heel end 132, a front end 134, a back end 136, a face portion 140, a top wall portion 142 (e.g., a crown), and a bottom wall portion 144 (e.g., a sole). The golf club head 100 may be made of one or more metal materials such as titanium, titanium alloy, and/or any other suitable materials.

The toe end 130 may be opposite of the heel end 132, and the front end 134 may be opposite of the back end 136. The face portion 140 may be located in the front end 134 and configured to impact a golf ball (not shown). In particular, the face portion 140 may include a plurality of grooves 150. The plurality of grooves 150 may be elongated in a direction between the toe end 130 and the heel end 132 on the face portion 140. The top wall portion 142 may be opposite of the bottom wall portion 144.

The golf club head 100 may also include a hosel 160 and a hosel transition 165. For example, the hosel 160 may be located at or proximate to the heel end 132. The hosel 160 may extend from the club head 100 via the hosel transition 165. To form a golf club, the hosel 160 may receive a first end of a shaft 198. The shaft 198 may be secured to the golf club head 100 by an adhesive bonding process (e.g., epoxy) and/or other suitable bonding processes (e.g., mechanical bonding, soldering, welding, and/or brazing). Further, a grip 199 may be secured to a second end of the shaft 198 to complete the golf club.

While the above examples describe various portions and/or surfaces of the golf club head 100, the golf club head 100 may not include certain portions and/or surfaces. For example, although one or more figures may depict the top wall portion 142 transitioning directly to the bottom wall portion 144, the golf club head 100 may include a separate side wall portion (e.g., a skirt). In particular, the side wall portion may be located between the top wall portion 142 and the bottom wall portion 144, and wrap around the back end 136 of the golf club head 100 from the toe end 130 to the heel end 132. Further, while one or more of figures may depict the hosel 160 and the hosel transition 165, the golf club head 100 may not include the hosel 160 and/or the hosel transition 165. In one example, the club head 100 may include a bore (not shown) within the golf club head 100 to receive a shaft (e.g., an opening of the bore may be relatively flushed with the top wall portion 142).

Referring to FIG. 2, for example, the golf club head 100 may be associated with a front end plane 210, a ground plane 220, and a loft plane 230. The front end plane 210 may be perpendicular to the ground plane 220. The ground plane 220 may be substantially parallel to the bottom wall portion 144 of the golf club head 100. The loft plane 230 may be substantially parallel to the face portion 140 of the golf club head 100 and may intersect with the ground plane 220 at the intersection line 235. The front end plane 210 and the loft plane 230 may form a loft angle 250 (θ).

As noted above, spin may be imparted on a golf ball (not shown) when the golf club head 100 impacts the golf ball. Ball flight and flight distance of the golf ball may vary based on the spin imparted by the golf club head 100. For example, a golf club head with a relatively higher loft angle may impart a relatively higher ball flight but may provide a relatively shorter flight distance. In contrast, a golf club head with a relatively lower loft angle may provide a relatively farther flight distance but impart a relatively lower ball flight. Thus, a set of golf clubs may include a progression of loft angles to provide an individual with a range of ball flights and flight distances. Instead of manufacturing a weight at an identical position in golf club heads with various loft angles, an internal and/or external weight (not shown) may be positioned based on the loft angle 250 as described in detail below. The methods, apparatus, and articles of manufacture described herein are not limited this regard.

In the examples of FIGS. 3-10, each of a first golf club head 300 (e.g., shown in FIGS. 3, 5, 7, and 9) and a second golf club head 400 (e.g., shown in FIGS. 4, 6, 8, and 10) may include a weight, generally shown as a first weight (e.g., 710 of FIG. 7) and a second weight (e.g., 810 of FIG. 8), respectively. As described in detail below, each of the first weight 710 (FIG. 7) and the second weight 810 (FIG. 8) may be associated with a particular weight position based on a loft angle. Although the first and second weights 710 and 810 may be depicted as internal weights (e.g., within the first and second golf club heads 300 and 400 respectively), the first and second weights 710 and 810 may be external weights. Alternatively, the first and second weights 710 and 810 may include an internal portion and an external portion relative to the first and second golf club heads 300 and 400, respectively.

Figure 3:
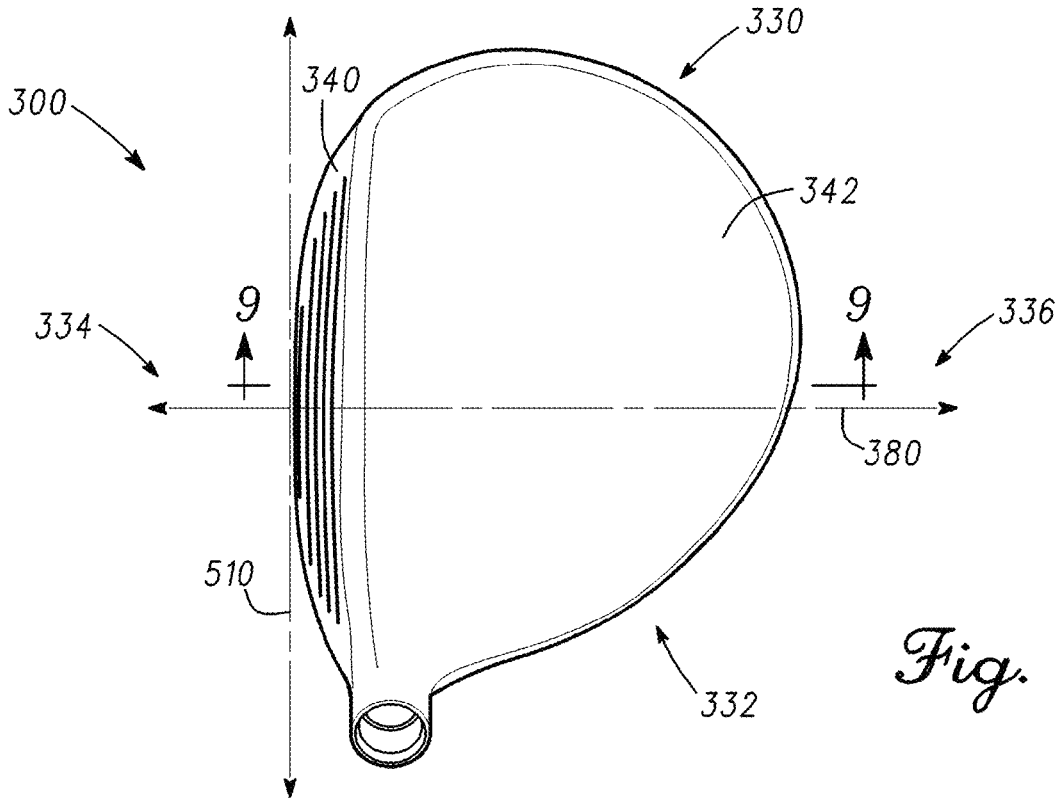
FIG. 3 depicts a top view of an example golf club head.
Figure 5:
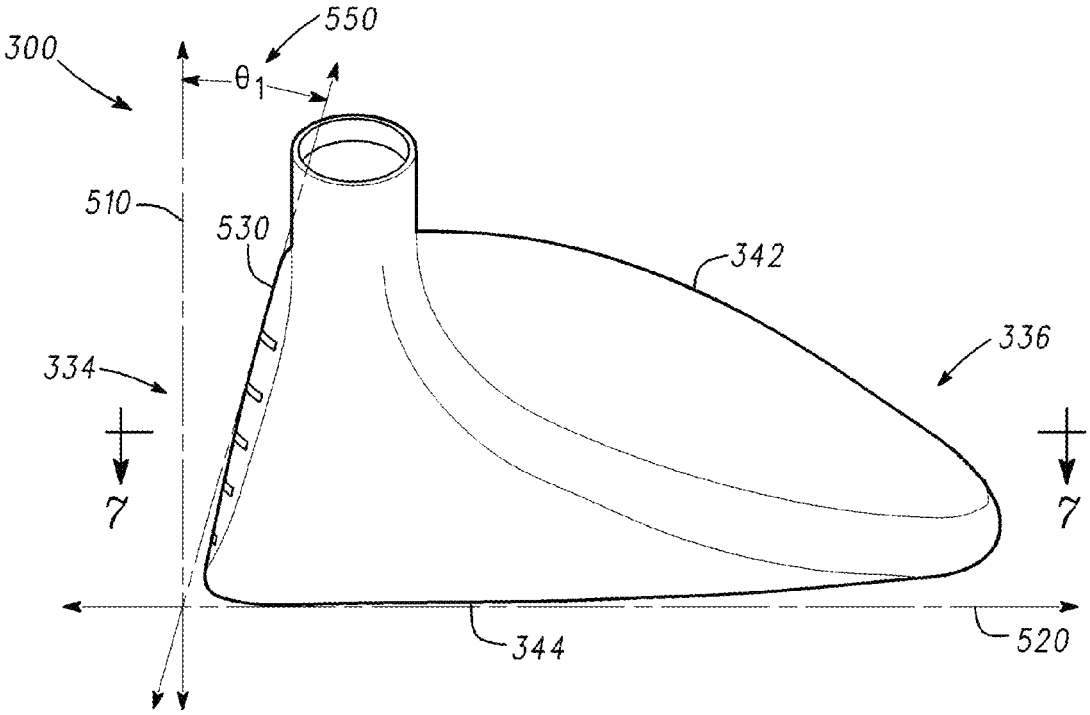
FIG. 5 depicts a heel end view of the example golf club head of FIG. 3.
Figure 7:
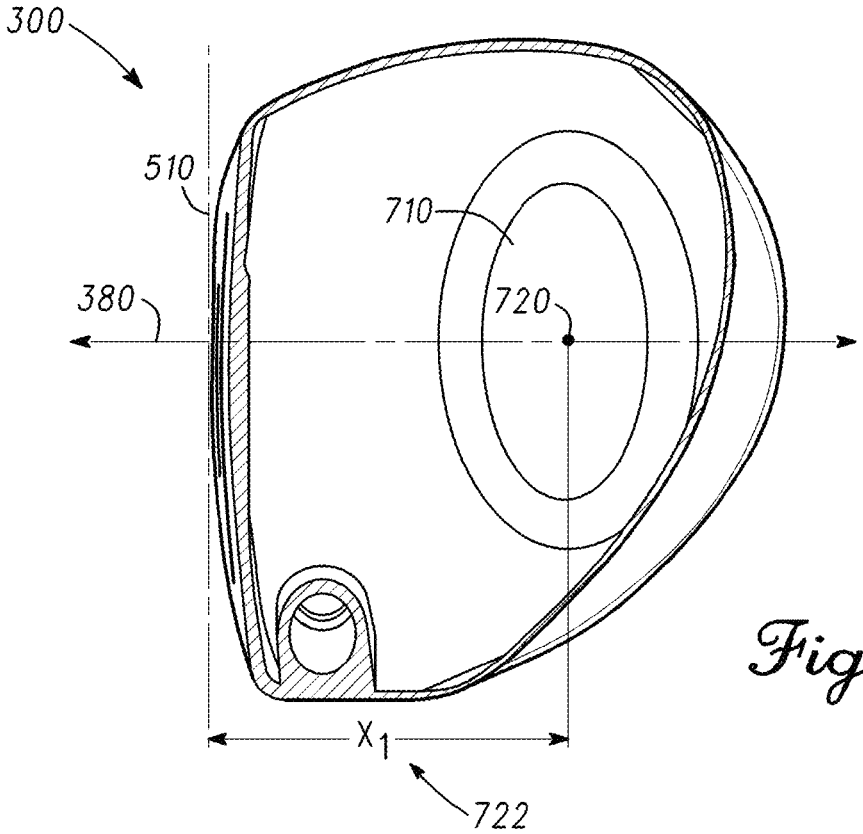
FIG. 7 depicts a cross-sectional view of the example golf club head of FIG. 3 along the line 7-7.

As illustrated in FIGS. 3, 5, 7, and/or 9, the first golf club head 300 may include a first toe end 330, a first heel end 332, a first front end 334, a first back end 336, a first face portion 340, a first top wall portion 342, and a first bottom wall portion 344. For example, the first golf club head 300 may be associated with a first front end plane 510, a first ground plane 520, and a first loft plane 530. Similar to the front end plane 210 and the ground plane 220 as described above and shown in FIG. 2, the first front end plane 510 may be perpendicular to the first ground plane 520. The first ground plane 520 may be substantially parallel to the first bottom wall portion 344 of the first golf club head 300. The first front end plane 510 and the first ground plane 520 may be perpendicular to each other and intersect at a first intersection line 535. The first loft plane 530 may be substantially parallel to the first face portion 340 of the first golf club head 300. The first loft plane 530 may also intersect with the first ground plane 520 at the first intersection line 535. The first front end plane 510 and the first loft plane 530 may form a first loft angle 550 ($\theta_1$).

The first front end plane 510 may intersect a first axis 380 (FIGS. 3 and 7) extending from the first front end 334 to the first back end 336 of the first club head 300. In one example, the first axis 380 may be centered relative to the first face portion 340 of the first club head 300. In another example, the first axis 380 may be positioned toward the first heel end 332 or the first toe end 330 of the first golf club head 300. In addition or alternatively, the first axis 380 may be position toward the first top wall portion 342 or the first bottom wall portion 344.

Figure 4:
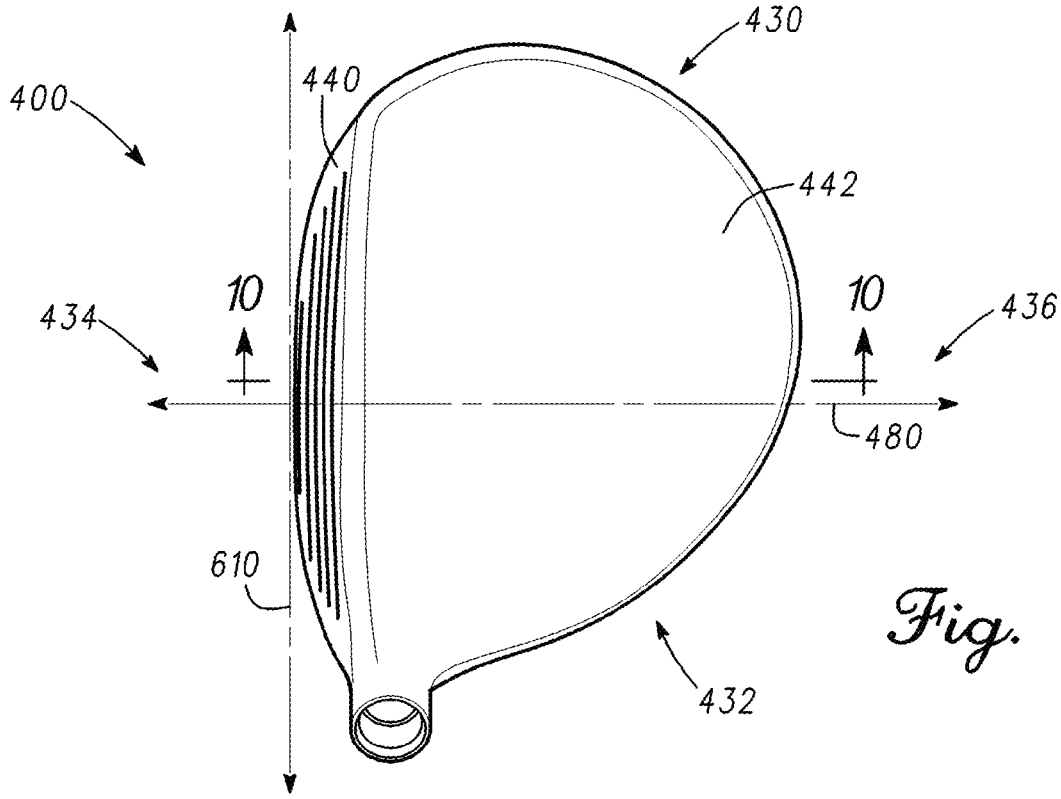
FIG. 4 depicts a top view of another example golf club head.
Figure 6:
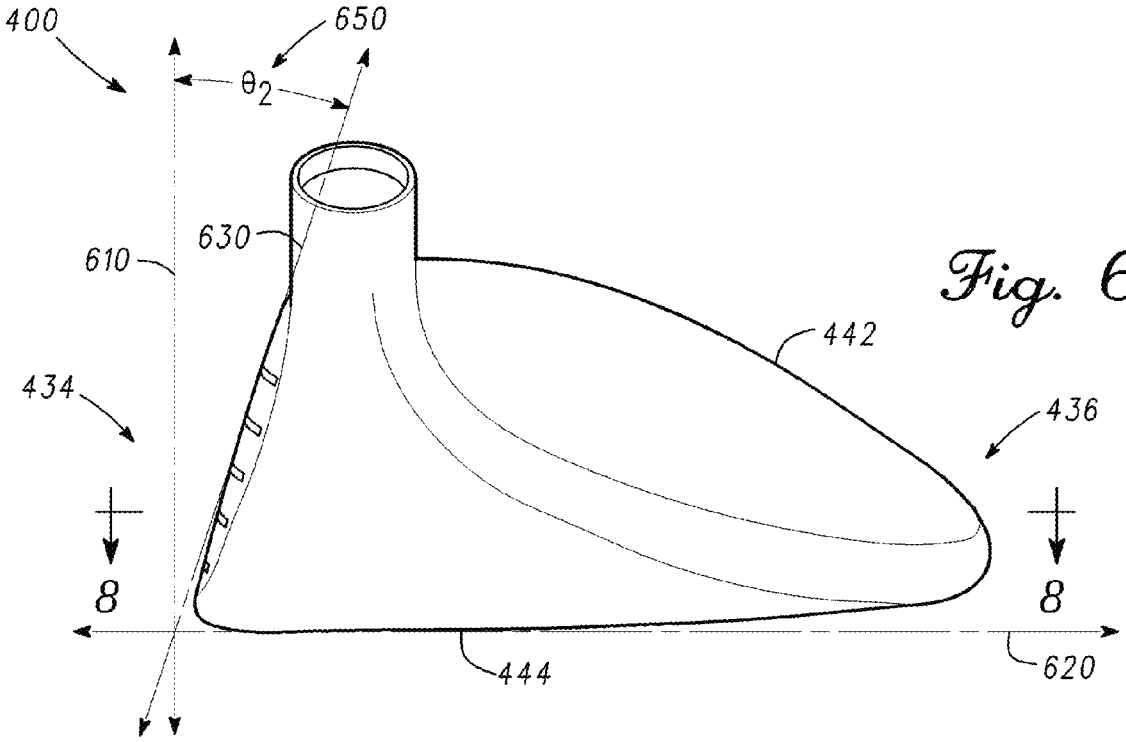
FIG. 6 depicts a heel end view of the example golf club head of FIG. 4.
Figure 8:
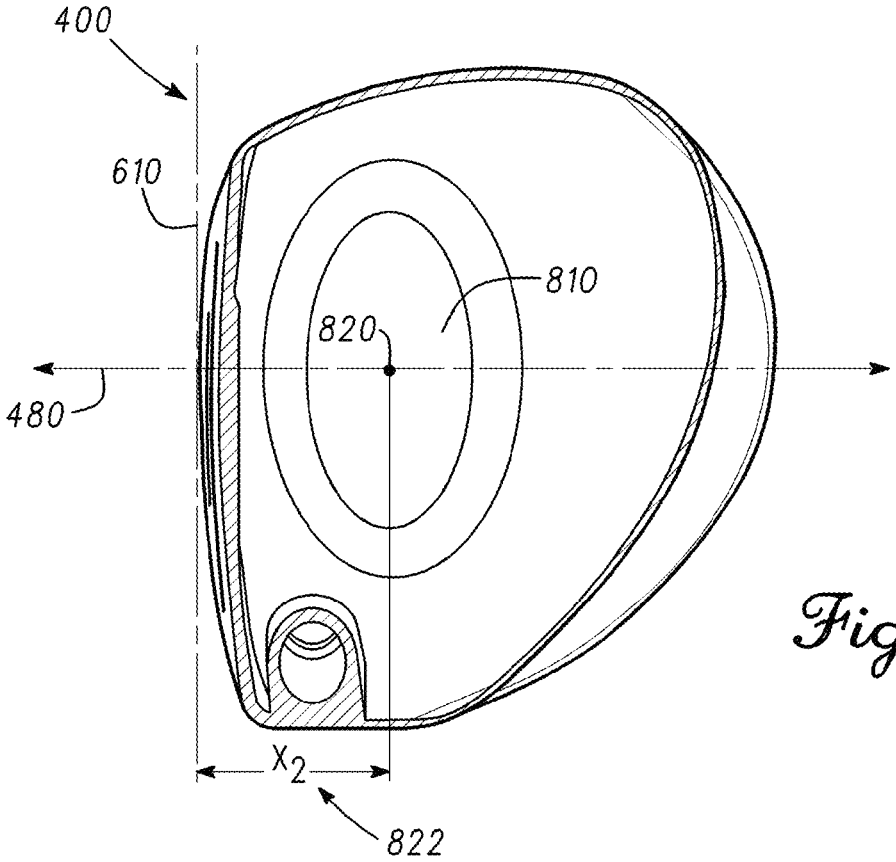
FIG. 8 depicts a cross-sectional view of the example golf club head of FIG. 4 along the line 8-8.
Figure 9:
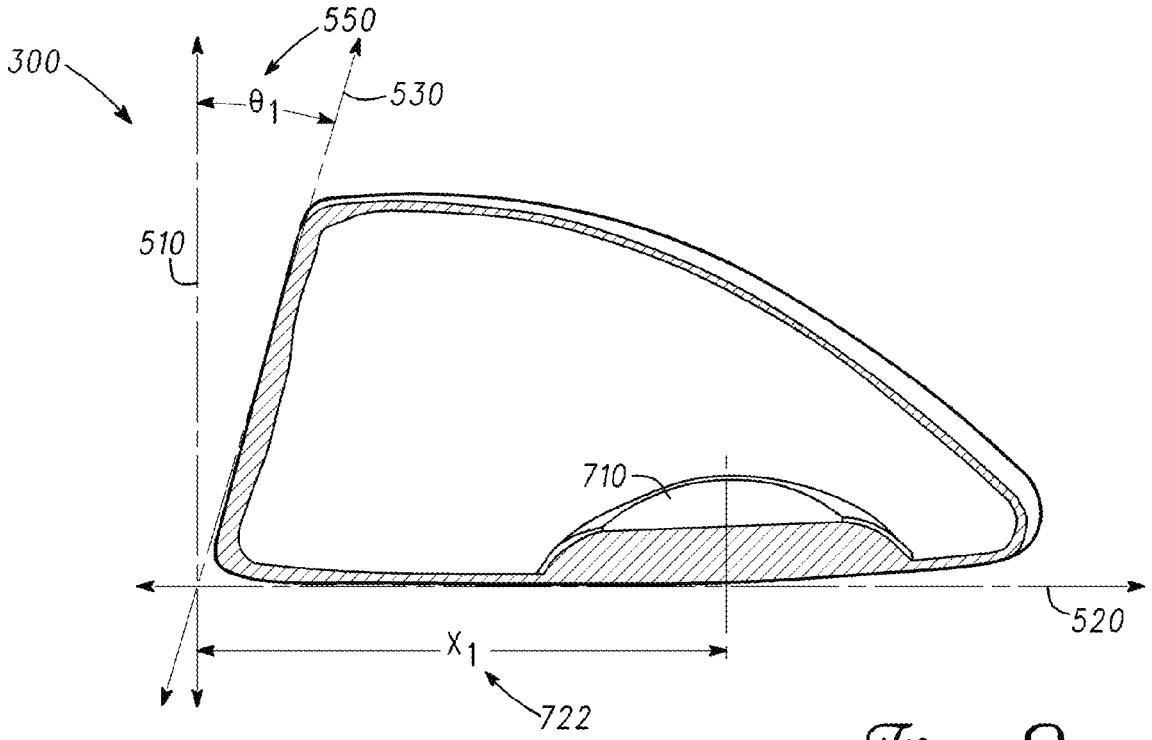
FIG. 9 depicts a cross-sectional view of the example golf club head of FIG. 5 along the line 9-9.

In a similar manner as depicted in FIGS. 4, 6, 8, and/or 10, a second golf club head 400 may include a second toe end 430, a second heel end 432, a second front end 434, a second back end 436, a second face portion 440, a second top wall portion 442, and a second bottom wall portion 444. For example, the second golf club head 400 may be associated with a second front end plane 610, a second ground plane 620, and a second loft plane 630. Similar to the first front end plane 510 and the first ground plane 520 as described above (FIG. 5), the second front end plane 610 and the second ground plane 620 may be perpendicular to each other and intersect at a second intersection line 635. The second ground plane 620 may be substantially parallel to the second bottom wall portion 644 of the second golf club head 400. The second loft plane 630 may be substantially parallel to the second face portion 640 of the second golf club head 400. The second loft plane 630 may also intersect with the second ground plane 620 at the second intersection line 635. The second front end plane 610 and the second loft plane 630 may form a second loft angle 650 ($\theta_2$).

The second front end plane 610 may intersect a second axis 480 (FIGS. 4 and 8) extending from the second front end 434 to the second back end 436 of the second club head 400. In one example, the second axis 480 may be centered relative to the second face portion 440 of the second club head 400. In another example, the second axis 480 may be positioned toward the second heel end 432 or the second toe end 430 of the second golf club head 400. In addition or alternatively, the second axis 480 may be positioned toward the second top wall portion 442 or the second bottom wall portion 444.

Figure 10:
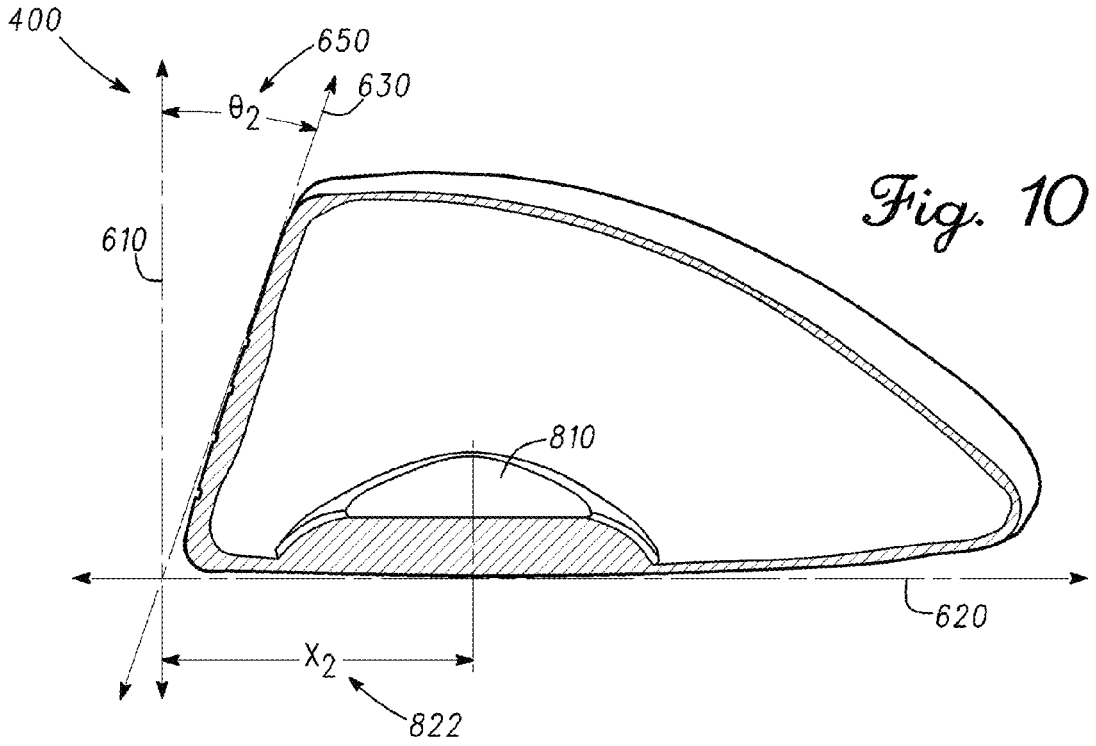
FIG. 10 depicts a cross-sectional view of the example golf club head of FIG. 6 along the line 10-10.

As noted above, the first golf club head 300 may include a first weight 710 (FIGS. 7 and 9) and the second golf club head 400 may include a second weight 810 (FIGS. 8 and 10). In particular, the first weight 710 may be associated with a first weight position 720 whereas the second weight 810 may be associated with a second weight position 820. The first weight position 720 may be located at or proximate to a distance along the first axis 380 between the first loft plane 530 and the first back end 336. The second weight position 820 may be located at or proximate to a distance along the second axis 480 between the second loft plane 630 and the second back end 436. In one example, the first weight position 720 may correspond to a location of a center of mass of the first weight 710, and the second weight position 820 may correspond to a location of a center of mass of the second weight 810. Alternatively, the first weight position 720 may be correspond to a location of an edge of the first weight 710, and the second weight position 820 may correspond to an edge of the second weight 810 (e.g., a front edge or a back edge of the weight).

The first weight position 720 may be defined by the first loft angle 550 whereas the second weight position 820 may be defined by the second loft angle 650. Further, the first weight position 720 may be located at or proximate to a first distance 722 ($X_1$) from the first front end plane 510 whereas the second weight position 820 may be located at or proximate to a second distance 822 ($X_2$) from the second front end plane 610. In general, the second loft angle 650 is greater than the first loft angle 550 ($\theta_2>\theta_1$). However, the second weight position 820 may be located relatively closer to the second front end plane 610 than the first weight position 720 relative to the first front end plane 510 ($\theta_1>\theta_2$). Accordingly, as the loft angle increases, the distance of the weight position relative to the front end plane may decrease (e.g., the weight may be positioned closer to the front end plane). Therefore, the distance of the weight position relative to the front end plane may be inversely proportional to the loft angle of a golf club head.

Although the figures may depict the first and second weights 710 and 810 having elliptical shapes, the first and/or second weights 710 and 810 may have circular shapes, polygonal shapes, free-formed shapes (e.g., figure-eight shapes, kidney shapes, etc.), or any other suitable shapes. While the first and second weights 710 and 810 may be depicted as having the same shape, the first and second weights 710 and 810 may have different shapes. In one example, each of the first and second weights 710 and 810 may be at least 48 grams. Also, the first and second weights 710 and 810 may be approximately 2.3 inches in length, 1.5 inches in width, and 0.3 inches in height. The first and/or second weights 710 and 810 may be a single weight or a plurality of weights with other dimensions. The first and/or second weights 710 and 810 may include metal material such as steel, titanium, titanium alloy, tungsten, and/or any other suitable materials. While the above examples may depict weights of particular size, shape, and/or material, the apparatus, methods, and articles of manufacture described herein may include weights configured in various sizes, shapes, and/or materials. The methods, apparatus, and articles of manufacture described herein are not limited in this regard.

Figure 11:
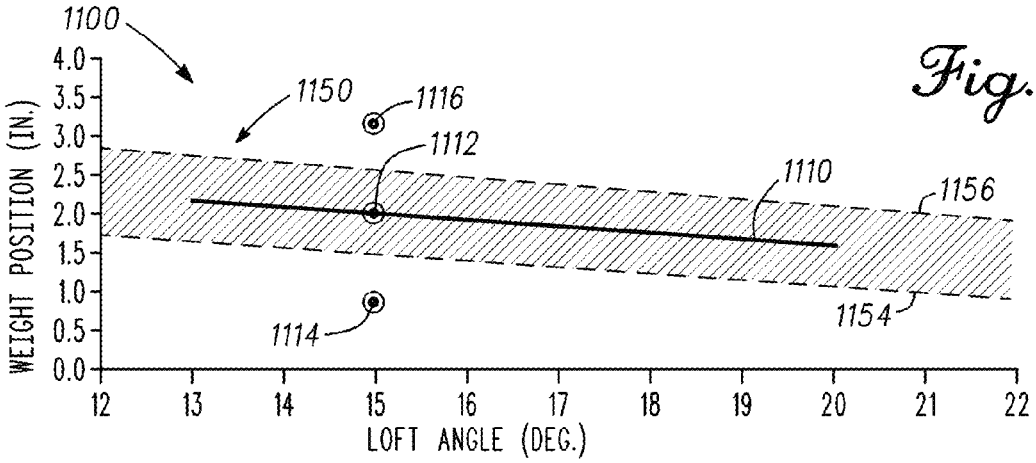
FIG. 11 depicts an example graph of weight position versus loft angle.

In general, the weight position (e.g., the first weight position 720 of FIG. 7 or the second weight position 820 of FIG. 8) may be based on the loft angle of a golf club head. The distance between the weight position and the front end plane may be a function of the loft angle in either a linear manner (e.g., FIG. 11) or a non-linear manner (e.g., FIG. 12). In the example of FIG. 11, a linear relationship 1100 between the weight position and the loft angle may be defined by the equation of $x=(-0.086*\theta)+3.297$, where x represents the distance between the weight position and the front end plane in units of inches (in), and θ represents the loft angle in units of degrees (°) (e.g., shown as line 1110). As the loft angle increases, the distance between the weight position and the front end plane decreases. For example, the equation may indicate that the weight may be positioned at or about two (2) inches from the front end plane for a golf club head with a 15-degree loft angle whereas the weight may be positioned at or about one-and-a-half (1.5) inches from the front end plane for a golf club head with a 20-degree loft angle. Further, a suitable range of weight positions for a golf club head with a 15-degree loft angle may extend between 1.5 inches (1114) to 2.5 inches (1116). Alternatively, the relationship between the weight position and the loft angle may be defined by a range. As shown in dashed lines, for example, a range of suitable weight positions 1150 may be defined by a lower boundary 1154 and an upper boundary 1156. The range of suitable weight positions 1150 may be defined by the equation $(-0.086*\theta)+3.797 \geq x \geq (-0.086*\theta)+2.797$. Although FIG. 11 may depict an exemplary equation with a particular range of loft angles, the methods, apparatus, and articles of manufacture described herein are not limited in this regard.

Figure 12:
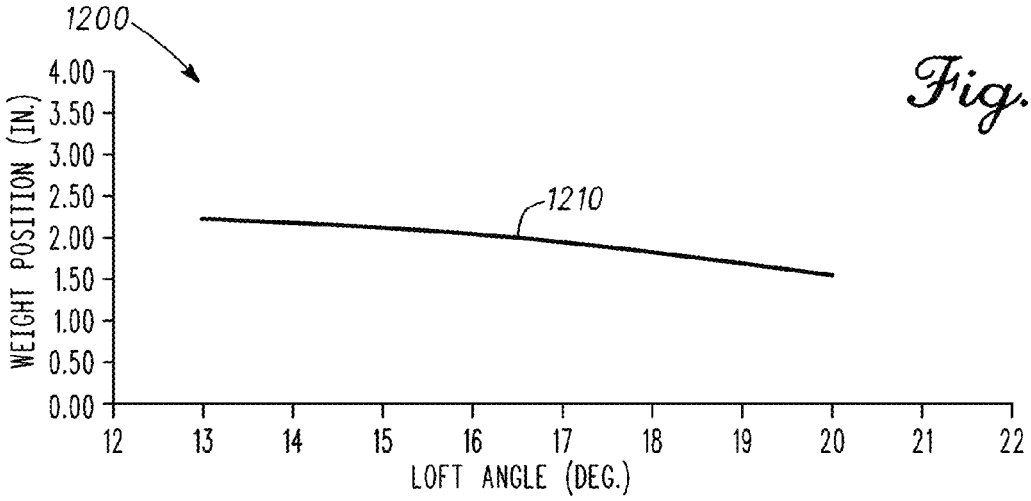
FIG. 12 depicts another example graph of weight position versus loft angle.

Alternatively, as noted above, the weight position may be inversely proportional to the loft angle in a non-linear manner. Referring to FIG. 12, for example, a non-linear relationship 1200 between the weight position and the loft angle may be defined by the equation of $x=(-0.009*\theta\hat{}2)+(0.194*\theta)+1.192$, where x represents the weight position in units of inches (in), and θ represents the loft angle in units of degrees (°) (e.g., shown as line 1210). As the loft angle increases, the distance between the weight position and the front end plane decreases. While FIG. 12 may depict an exemplary equation with a particular range of loft angles, the methods, apparatus, and articles of manufacture described herein are not limited in this regard.

Figure 13:
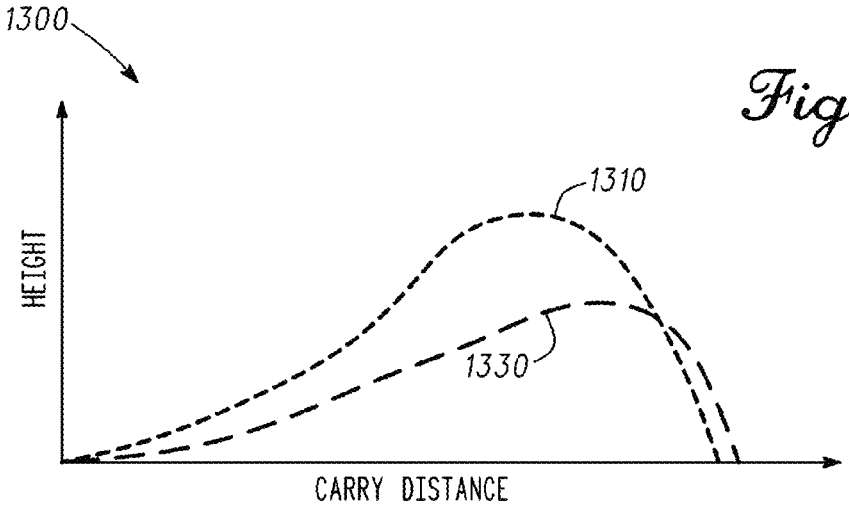
FIG. 13 depicts an example graph of ball height versus carry distance.

Turning to FIG. 13, for example, each golf shot from a golf club head may be associated with a ball flight trajectory 1300, generally shown as a first trajectory 1310, a second trajectory 1320, and a third trajectory 1330. For the examples described below, the club head speed and the loft angle associated with the all flight trajectories 1300 may be constant. In particular, the ball flight trajectories 1300 may represent the effect of weight position of a golf club head on height and carry distance of a golf ball. The ball flight trajectories 1300 may vary based on the movement of a weight along an axis that may be perpendicular to the front end plane (e.g., the axis 380 of FIG. 3 or the axis 480 of FIG. 4).

In one example, the second trajectory 1320 may represent a weight position to provide optimal spin and carry distance. In contrast, a weight position associated with the first trajectory 1310 may be farther from a front end plane than a weight position associated with the second trajectory 1320. As a result, the weight position associated with the first trajectory 1310 may generate relatively more spin resulting in relatively higher ball flight and less carry distance. In another example, a weight position associated with the third trajectory 1330 may be closer to a front end plane than a weight position associated with the second trajectory 1320. Thus, a weight position associated with the third trajectory 1330 may be generate relatively less spin resulting in relatively lower ball flight and less carry distance. The methods, apparatus, and articles of manufacture described herein are not limited in this regard.

As a result, a golf club head with a relatively lower loft angle and a weight positioned relatively farther from a front end plane may increase the amount of spin imparted on a golf ball to increase ball flight of the golf ball. A golf club head with a relatively higher loft angle and a weight position relatively closer to the front end plane may reduce the amount of spin imparted on a golf ball to increase the flight distance traveled by the golf ball. Further, the golf club head with the relatively higher loft angle and the weight position relatively closer to the front end plane may rotate relatively less than the golf club head with the relatively lower loft angle and the weight positioned relatively farther from the front end plane. With relatively less rotation at impact with the golf ball, the amount of vibration may be reduced to provide a better feel. The methods, apparatus, and articles of manufacture described herein are not limited in this regard.

Although the above examples describe various portions and/or surfaces of the golf club head 100, the golf club head 100 may not include certain portions and/or surfaces. For example, while FIG. 1 may depict the top wall portion 142, the bottom wall portion 144, and the side wall 146 as separate surfaces, the side wall 146 may merge with either the top wall portion 142 or the bottom wall portion 144 into a single surface of the hollow body 110 (e.g., the body 110 may include the top wall portion 142 and the bottom wall portion 144 but not the side wall 146). In one example, the bottom wall portion 144 and the side wall 146 may merge into a single bottom surface of the body 110. Further, although FIG. 1 may depict the hosel 160 and the hosel transition 165, the golf club head 100 may not include the hosel 160 and/or the hosel transition 165. In one example, the golf club head 100 may include a bore (not shown) within the body 110 to receive the shaft 198 (e.g., an opening of the bore may be flushed with the top wall portion 142).

While some of the above figures may depict a utility club head or a metal wood-type club head (e.g., drivers, fairway woods, etc.), the methods, apparatus, and articles of manufacture described herein may be readily applicable to other suitable types of golf club heads. For example, the methods, apparatus, and articles of manufacture described herein may be applicable to hybrid-type club heads, iron-type club heads, or other suitable types of golf club heads. The methods, apparatus, and articles of manufacture described herein are not limited this regard.

Figure 14:
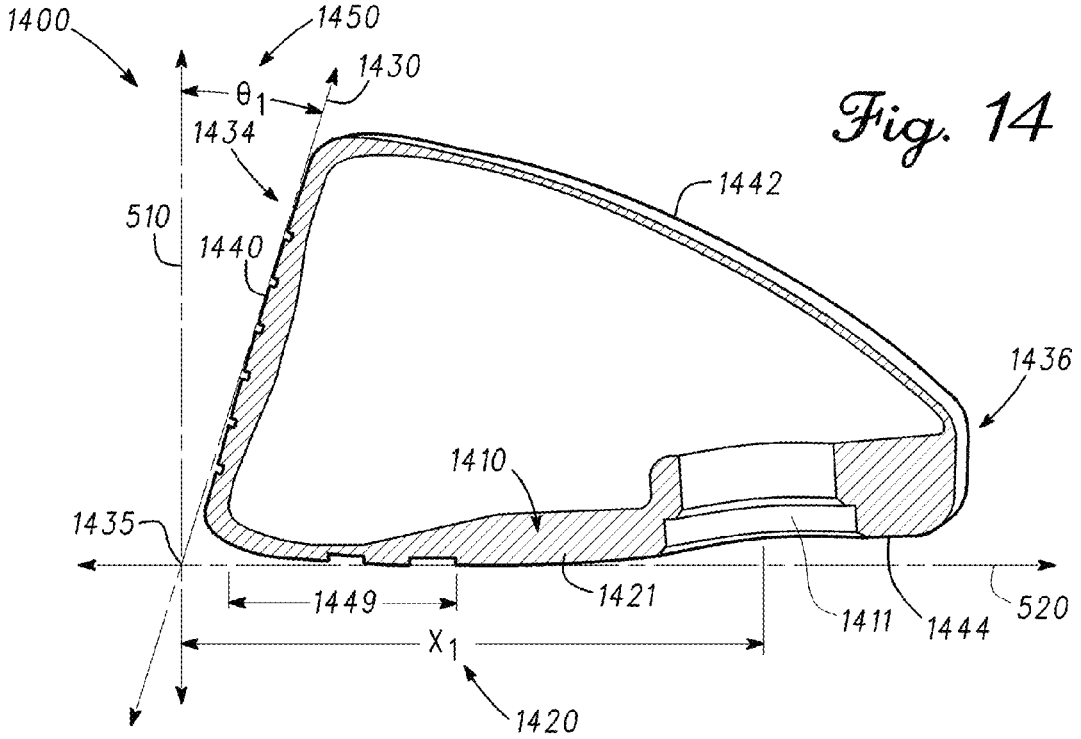
FIG. 14 depicts a cross-sectional view of the example golf club head, according to a second embodiment.
Figure 15:
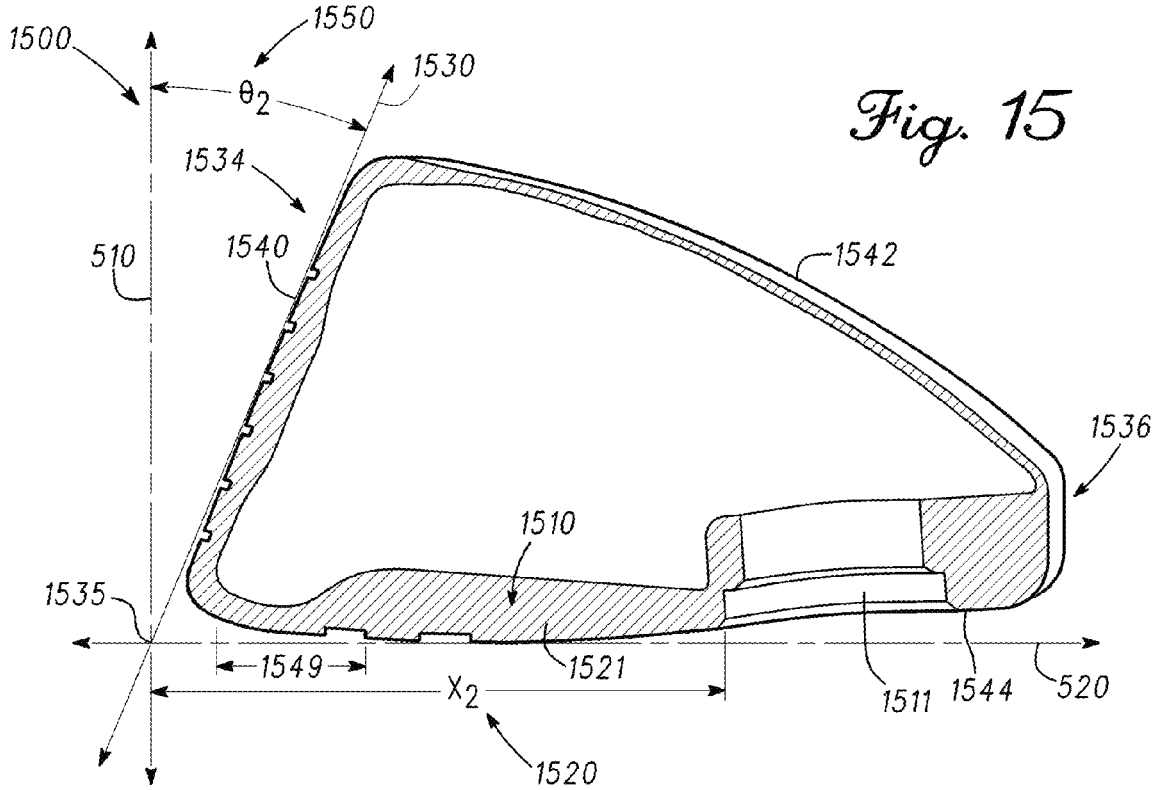
FIG. 15 depicts a cross-sectional view of another example golf club head, according to the second embodiment.

Turning to another embodiment, FIG. 14 depicts a cross-sectional view of an example golf club head 1400, according to a second embodiment. FIG. 15 depicts a cross-sectional view of another exemplary golf club head 1500, according to the second embodiment. FIG. 16 depicts a cross-sectional view of a further exemplary golf club head 1600, according to the second embodiment. Golf club heads 1400, 1500, and 1600 are merely exemplary and are not limited to the embodiments presented herein. Golf club heads 1400, 1500, and 1600 can be employed in many different embodiments or examples not specifically depicted or described herein.

In the examples of FIGS. 14-16, each of a first golf club head 1400 (FIG. 14), a second golf club head 1500 (FIG. 15), and a third golf club head 1600 (FIG. 16) can include a weight, generally shown as a first weight (e.g., 1410 of FIG. 14), a second weight (e.g., 1510 of FIG. 15), and a third weight (e.g., 1610 of FIG. 16) respectively. As used herein, the first weight 1410 (FIG. 14), the second weight 1510 (FIG. 15), and third weight 1610 (FIG. 16) refer to the weight of the entire club head. That is, the first weight 1410 (FIG. 14), the second weight 1510 (FIG. 15), and the third weight 1610 (FIG. 16) include the mass of the back sole weights (i.e., weights 1411 (FIG. 14), 1511 (FIGS. 15), and 1611 (FIG. 16)) plus the other mass of the other parts of the first golf club head 1400 (FIG. 14), the second golf club head 1500 (FIG. 15), and the third golf club head 1600 (FIG. 16). As described below, each of the first weight 1410 (FIG. 14), the second weight 1510 (FIG. 15), and third weight 1610 (FIG. 16) can have a center of mass (i.e., a weight position and center of gravity) that is dependent upon or otherwise related to a loft angle. Although the first, second, and third weights 1410, 1510, and 1610 can be depicted as internal weights (e.g., within first, second, and third golf club heads 1400, 1500, and 1600, respectively), first, second, and third weights 1410, 1510 and 1610 can be external weights. Alternatively, the first, second, and third weights 1410, 1510 and 1610 can include an internal portion and an external portion relative to the first, second, and third golf club heads 1400, 1500, and 1600, respectively.

In FIG. 14, the first golf club head 1400 can include a first front end 1434, a first back end 1436, a first face portion 1440, a first top wall portion 1442, a first bottom wall portion 1444, a first toe end similar to toe end 330 in FIG. 3, and a first heel similar to heel end 332 in FIG. 3. For example, first golf club head 1400 can be associated with front end plane 510, ground plane 520, and a first loft plane 1430. Ground plane 520 can be substantially parallel to the first bottom wall portion 1444 (or a bottom) of the first golf club head 1400. Front end plane 510 and ground plane 520 can be perpendicular to each other and intersect at a first intersection point 1435. The first loft plane 1430 can be substantially parallel to the first face portion 1440 of the first golf club head 1400. The first loft plane 1430 also can intersect with the first ground plane 520 and first front end plane 510 at the first intersection point 1435. The first front end plane 510 and the first loft plane 1430 can form a first loft angle 1450 ($\theta_1$). For hybrid golf clubs, the loft angles can range from 15 degrees to approximately 45 degrees.

The front end plane 510 can intersect a first axis extending from the first front end 1434 to the first back end 1436 of the first club head 1400. In one example, the first axis can be centered relative to the first face portion 1440 of the first club head 1400. In another example, the first axis can be positioned toward the first heel end or the first toe end of the first golf club head 1400. In addition or alternatively, the first axis can be positioned toward the first top wall portion 1442 or the first bottom wall portion 1444.

In FIG. 15, the second golf club head 1500 can include a second front end 1534, a second back end 1536, a second face portion 1540, a second top wall portion 1542, a second bottom wall portion 1544, a toe end similar to toe end 330 in FIG. 3, and a heel end similar to heel end 332 in FIG. 3. For example, the second golf club head 1500 can be associated with front end plane 510, ground plane 520, and a second loft plane 1530. The ground plane 520 can be substantially parallel to the first bottom wall portion 1544 (or a bottom) of the second golf club head 1500. The front end plane 510 and the ground plane 520 can be perpendicular to each other and intersect at a second intersection point 1535. The second loft plane 1530 can be substantially parallel to the second face portion 1540 of the second golf club head 1500. The second loft plane 1530 can also intersect with ground plane 520 and front end place 510 at second intersection point 1535. The front end plane 510 and the second loft plane 1530 can form a second loft angle 1550 ($\theta_2$).

The front end plane 510 can intersect a second axis extending from the second front end 1534 to the second back end 1536 of the second club head 1500. In one example, the second axis can be centered relative to the second face portion 1540 of the second club head 1500. In another example, the second axis can be positioned toward the second heel end or the second toe end of the second golf club head 1500. In addition or alternatively, the second axis can be position toward the second top wall portion 1542 or the second bottom wall portion 1544.

In FIG. 16, the third golf club head 1600 can include a third front end 1634, a third back end 1636, a third face portion 1640, a third top wall portion 1642, a third bottom wall portion 1644, a toe end similar to toe end 330 in FIG. 3, and a heel end similar to heel end 332 in FIG. 3. For example, the third golf club head 1600 can be associated with front end plane 510, ground plane 520, and a third loft plane 1630. The ground plane 520 can be substantially parallel to the third bottom wall portion 1644 (or a bottom) of the third golf club head 1600. The front end plane 510 and the ground plane 520 can be perpendicular to each other and intersect at a third intersection point 1635. The third loft plane 1630 can be substantially parallel to the third face portion 1640 of the third golf club head 1600. The third loft plane 1630 can also intersect with the ground plane 520 and front end place 510 at the third intersection point 1635. The front end plane 510 and the third loft plane 1630 can form a third loft angle 1650 ($\theta_3$).

The front end plane 510 can intersect a third axis extending from the third front end 1634 to the third back end 1636 of the third club head 1600. In one example, the third axis can be centered relative to the third face portion 1640 of the third club head 1600. In another example, the third axis can be positioned toward the third heel end or the third toe end of the third golf club head 1600. In addition or alternatively, the third axis can be position toward the third top wall portion 1642 or the third bottom wall portion 1644.

As noted above, the first golf club head 1400 can have the first weight 1410 (FIG. 14); the second golf club head 1500 can include the second weight 1510 (FIG. 15); and the third golf club head 1600 can include the third weight 1610 (FIG. 16). In particular, the first weight 1410 can be associated with a first weight position 1420 ($X_1$) (e.g., a depth of the center of mass of the golf club head 1400 in relation to the front end plane 510), whereas the second weight 1510 can be associated with a second weight position 1520 ($X_2$) (e.g., a depth of the center of mass of the golf club head 1500 in relation to the front end plane 510) and the third weight 1610 can be associated with a third weight position 1620 ($X_3$) (e.g., a depth of the center of mass of the golf club head 1500 in relation to the front end plane 510). The first weight position 1420 can be located at or proximate to a distance along the first axis between the first loft plane 1430 and the first back end 1436. The second weight position 1520 can be located at or proximate to a distance along the second axis between the second loft plane 1530 and the second back end 1536. The third weight position 1620 can be located at or proximate to a distance along the third axis between the third loft plane 1630 and the third back end 1636. That is, the first weight position 1420 can correspond to a location of a center of mass of the first weight 1410; the second weight position 1520 can correspond to a location of a center of mass of the second weight 1510; and the third weight position 1620 can correspond to a location of a center of mass of the third weight 1610.

As discussed herein, the first weight position 1420, the second weight position 1520, and the third weight position 1620 refer to the position of the center of mass of the golf club. In many examples, the location of the weight position is changed by altering or changing the geometry of the mass distribution, not just by moving a location of the back sole weights 1411 (FIG. 14), 1511 (FIG. 15), or 1611 (FIG. 16) or by changing the mass of the back sole weights 1411 (FIG. 14), 1511 (FIG. 15), or 1611 (FIG. 16). For example, the weight position is changed between the golf club head 1400 and the golf club head 1500 by changing the geometry of at least a portion of the mass by moving it forward and upward from distribution 1421 (FIG. 14) to distribution 1521 (FIG. 15). Similarly, the weight position is changed between the golf club head 1500 and the golf club head 1600 by changing the geometry of at least a portion of the mass by moving it even more forward and upward from distribution 1521 (FIG. 14) to distribution 1621 (FIG. 15).

In some examples, the center of mass of the golf club head with a low loft angle is kept far back and low. As the loft angle of the golf club head increases, the center of mass of the golf club head can be moved forward, but still kept relatively low. For the highest lofted clubs, the center of mass of the golf club head is moved even more forward and allowed to rise higher in the golf club head because it is more important for the mass to be forward than low in the clubs with the highest loft angles.

The first weight position 1420 can be defined by the first loft angle 1450, whereas the second weight position 1520 can be defined by the second loft angle 1550, and the third weight position 1620 can be defined by the third loft angle 1650. Further, the first weight position 1420 can be located at or proximate to a first distance ($X_1$) (i.e., the position of the center of mass for golf club head 1400) from the front end plane 510, whereas the second weight position 1520 can be located at or proximate to a second distance ($X_2$) (i.e., the position of the center of mass for golf club head 1500) from the front end plane 510, and the third weight position 1620 can be located at or proximate to a third distance ($X_3$) (i.e., the position of the center of mass for golf club head 1600) from the front end plane 510. In general, the second loft angle 1550 is greater than the first loft angle 1450 ($\theta_2>\theta_1$). Similarly, the third loft angle 1650 is greater than the second loft angle 1550 ($\theta_3>\theta_2$). However, the second weight position 1520 can be located relatively closer to the front end plane 510 than the first weight position 1420 relative to the front end plane 510 ($X_1>X_2$). Likewise, the third weight position 1620 can be located relatively closer to the front end plane 510 than the second weight position 1520 relative to the front end plane 510 ($X_2>X_3$). Accordingly, as the loft angle increases, the distance of the weight position relative to the front end plane can decrease (e.g., the weight can be positioned closer to the front end plane). Therefore, the distance of the weight position relative to the front end plane can be inversely proportional to the loft angle of a golf club head.

In the example shown in FIGS. 14-16, the distributions 1421, 1521, and 1621 have a non-uniform shape. In another example, the distributions 1421, 1521, and 1621 can have the shape (and the mass distribution) of the weights shown FIGS. 7-10. The distributions 1421, 1521, and 1621 can have elliptical shapes, circular shapes, polygonal shapes, free-formed shapes (e.g., figure-eight shapes, kidney shapes, etc.), or any other suitable shapes. While the distributions 1421, 1521, and 1621 can be have the same shape, the distributions 1421, 1521, and 1621 also can have different shapes.

In one example, each of the distributions 1421, 1521, and 1621, can have a weight of at least 60 grams. In the same or different embodiments, the distributions can be greater than 80 grams. Each of the distributions 1421, 1521, and 1621 can be a single weight or a plurality of weights with other dimensions. The distributions 1421, 1521, and 1621 can include metal material such as steel, titanium, titanium alloy, tungsten, and/or any other suitable materials. While the above examples can depict weights of a particular size, shape, and/or material, the apparatus, methods, and articles of manufacture described herein can include weights configured in various sizes, shapes, and/or materials. The methods, apparatus, and articles of manufacture described herein are not limited in this regard.

In general, the weight position (e.g., the first weight position 1420 of FIG. 14, the second weight position 1520 of FIG. 15, and the third weight position 1620 of FIG. 16) can be based on the loft angle of a golf club head. The distance between the weight position and the front end plane can be a function of the loft angle in either a linear manner or a non-linear manner, as explained below.

FIG. 17 illustrates a graph 1700 of an exemplary relationship between the loft angle and the depth of the center of mass of a golf club head, according to the second embodiment. Referring to FIG. 17, a linear relationship between the weight position (i.e., the depth of the center of mass of a golf club head) and the loft angle can be defined by the equation of $x=-0.0024*\theta+1.35$, where x represents the distance between the weight position and the front end plane in units of inches (in.), and $\theta$ represents the loft angle in units of degrees (°) (e.g., shown as line 1710). As the loft angle increases, the distance between the weight position and the front end plane decreases. For example, the equation can indicate that the weight can be positioned at or about 1.31 inches from the front end plane for a golf club head with a 17-degree loft angle whereas the weight can be positioned at or about 1.28 inches from the front end plane for a golf club head with a 31-degree loft angle. Further, a suitable range of weight positions for a golf club head with a 17-degree loft angle can extend between 1.16 inches (point 1714 in FIG. 17) to 1.46 inches (point 1716 in FIG. 17).

Alternatively, the relationship between the weight position and the loft angle can be defined by a range. In some embodiments, the slope of the line defining a suitable weight position can vary from −0.0005 to −0.03. In the same of different embodiments, the y-intercept of the equation defining the relationship between the loft angle and distance can vary from 1.2 inches to 1.5 inches. As shown in dashed lines in FIG. 17, for example, a range of suitable weight positions 1750 can be defined by a lower boundary 1754 and an upper boundary 1756. In one example, the range of suitable weight positions 1750 can be defined by the equation of $((-0.0024*\theta)+1.5)$ ≥x≥((−0.0024*θ)+1.2). In a further example, the range of suitable weight positions 1750 can be defined by the equation of ((−0.0005*θ)+1.5)≥x≥((−0.0300*θ)+1.2). In yet a further examples, the range of suitable weight positions 1750 can be defined by the equation of ((−0.0005*θ)+1.35)≥x≥((−0.0300*θ)+1.35). In another example, the range of suitable weight positions 1750 can be defined by the equation of ((−0.0005*θ)+1.45)≥x≥((−0.0300*θ)+1.25) or ((−0.0024*θ)+1.45)≥x≥((−0.0024*θ)+1.25). In yet another example, the range of suitable weight positions 1750 can be defined by the equation of ((−0.0024*θ)+1.40)≥x≥((−0.0024*θ)+1.30). Although FIG. 17 can depict an exemplary equation with a particular range of loft angles, the methods, apparatus, and articles of manufacture described herein are not limited in this regard.

Figure 18:
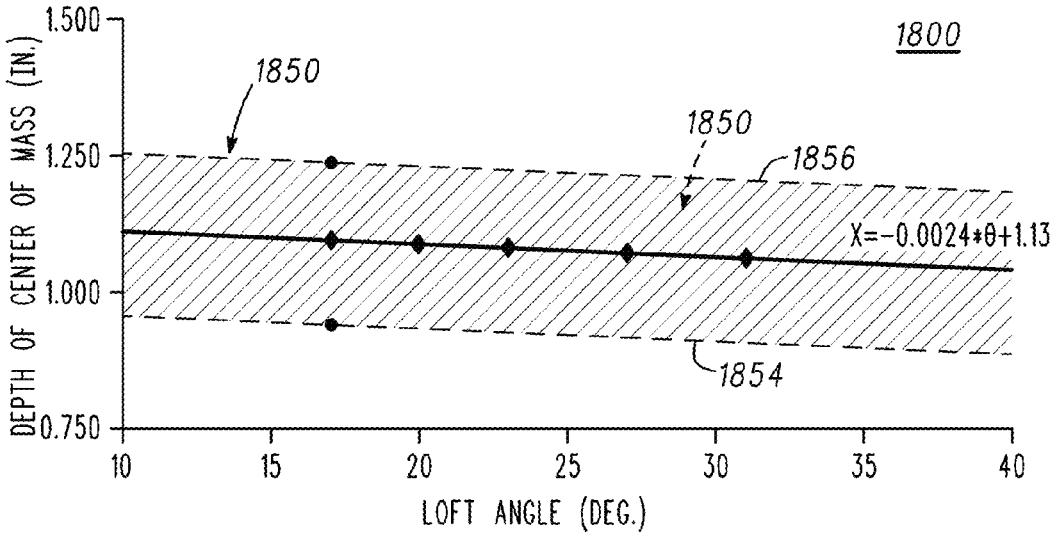
FIG. 18 illustrates a graph of another exemplary relationship between loft angle and the depth of center of mass of a golf club head, according to the second embodiment.

In another example, FIG. 18 illustrates a graph 1800 of another exemplary relationship between the loft angle and the depth of the center of mass of a golf club head, according to the second embodiment. Referring to FIG. 18, a linear relationship between the weight position (i.e., the depth of the center of mass of a golf club head) and the loft angle can be defined by the equation of x=−0.0024*θ+1.13, where x represents the distance between the weight position and the front end plane in units of inches (in.), and θ represents the loft angle in units of degrees (°) (e.g., shown as line 1810). As the loft angle increases, the distance between the weight position and the front end plane decreases. For example, the equation can indicate that the weight can be positioned at or about 1.09 inches from the front end plane for a golf club head with a 17-degree loft angle whereas the weight can be positioned at or about 1.06 inches from the front end plane for a golf club head with a 31-degree loft angle. Further, a suitable range of weight positions for a golf club head with a 17-degree loft angle can extend between 0.94 inches (point 1814 in FIG. 18) to 1.24 inches (point 1816 in FIG. 18).

Alternatively, the relationship between the weight position and the loft angle can be defined by a range. In some embodiments, the slope of the line defining a suitable weight position can vary from −0.0005 to −0.03. In the same of different embodiments, the y-intercept of the equation defining the relationship between the loft angle and distance can vary from 0.98 inches to 1.28 inches. As shown in dashed lines in FIG. 18, for example, a range of suitable weight positions 1850 can be defined by a lower boundary 1854 and an upper boundary 1856. In one example, the range of suitable weight positions 1850 can be defined by the equation of ((−0.0024*θ)+1.28)≥x≥((−0.0024*θ)+0.98). In a further example, the range of suitable weight positions 1850 can be defined by the equation of ((−0.0005*θ)+1.28)≥x≥((−0.0300*θ)+0.98). In another example, the range of suitable weight positions 1750 can be defined by the equation of ((−0.0024*θ)+1.23)≥x≥((−0.0024*θ)+1.03). In yet another example, the range of suitable weight positions 1850 can be defined by the equation of ((−0.0024*θ)+1.18)≥x≥((−0.0024*θ)+1.08). Although FIG. 18 can depict an exemplary equation with a particular range of loft angles, the methods, apparatus, and articles of manufacture described herein are not limited in this regard. In some examples, the relationship between the weight position and the loft angle shown in FIG. 17 can be used for fairway wood golf clubs, and the relationship between the weight position and the loft angle shown in FIG. 18 can be used for hybrid golf clubs.

Figure 19:
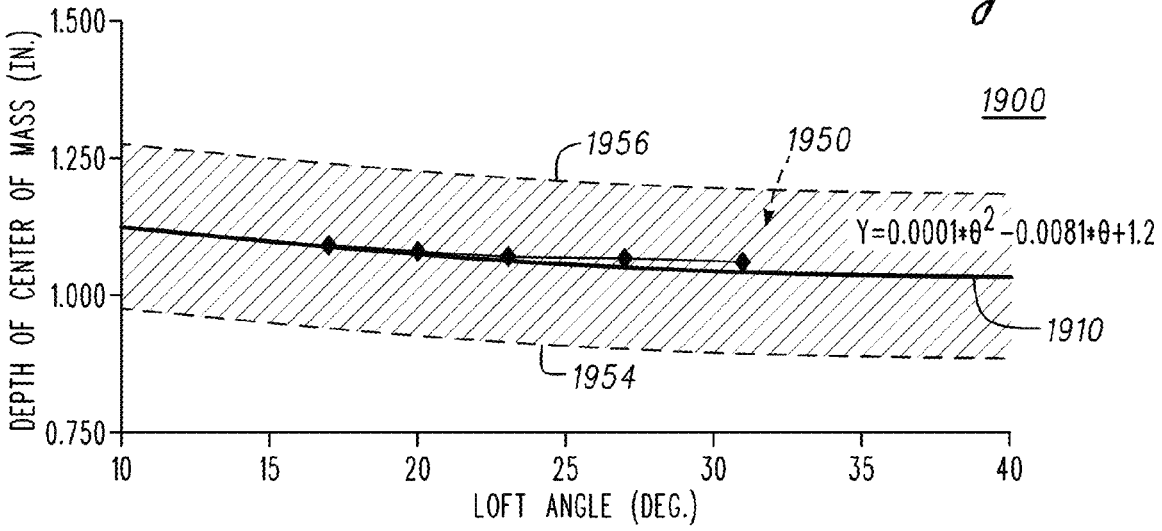
FIG. 19 illustrates a graph of a further exemplary relationship between loft angle and the depth of center of mass of a golf club head, according to the second embodiment.

Alternatively, as noted above, the weight position can be inversely proportional to the loft angle in a non-linear manner. FIG. 19 illustrates a graph 1900 of still another exemplary relationship between loft angle and the depth of center of mass of a golf club head, according to the second embodiment. Referring to FIG. 19, for example, a non-linear relationship 1900 between the weight position (i.e., the depth of center of mass of a golf club head) and the loft angle can be defined by the equation of x=(0.0001*θ^2)+(−0.0081*θ)+1.2, where x represents the weight position in units of inches (in.), and θ represents the loft angle in units of degrees (°) (e.g., shown as line 1910). As the loft angle increases, the distance between the weight position and the front end plane decreases in a non-linear manner.

The relationship between the weight position and the loft angle shown in FIG. 19 can be defined by a range. As shown in dashed lines in FIG. 19, for example, a range of suitable weight positions 1950 can be defined by a lower boundary 1954 and an upper boundary 1956. In one example, the range of suitable weight positions 1950 can be defined by the equation of ((0.0001*θ^2)+(−0.0081*θ)+1.35))≥x≥((0.0001*θ^2)+(−0.0081*θ)+1.05)). In a further example, the range of suitable weight positions 1950 can be defined by the equation of ((0.0001*θ^2)+(−0.0081*θ)+1.30))≥x≥((0.0001*θ^2)+(−0.0081*θ)+1.10)). In another example, the range of suitable weight positions 1950 can be defined by the equation of ((0.0001*θ^2)+(−0.0081*θ)+1.25))≥x≥((0.0001*θ^2)+(−0.0081*θ)+1.15)). Although FIG. 19 can depict an exemplary equation with a particular range of loft angles, the methods, apparatus, and articles of manufacture described herein are not limited in this regard. In some examples, the relationship between the weight position and the loft angle shown in FIG. 19 can be used for hybrid golf clubs. While FIG. 19 can depict an exemplary equation with a particular range of loft angles, the methods, apparatus, and articles of manufacture described herein are not limited in this regard.

The embodiment described herein can have a unique relationship between the CG (center of mass) and the loft angle. As the loft angle increases, the depth of the CG from the loft angle plane decreases (i.e., CG gets closer to the face of the club) as shown, for example, in FIGS. 17-19. This relationship is contrary to traditional notions of CG placement. Traditionally, as the loft angle of the golf club increases, the CG moves deeper into the club head as a result of the relative flattening of the club face. Also, traditionally, as the loft angle increases, the CG moves lower in the club head. This traditional change is because the club face is the thickest (heaviest) part of the golf club head so, as the face leans more toward the rear of the club head, the CG also moves in the same direction. The CG also moves lower due to the increase in weight of each club head as the club heads move from a low loft angle to a high loft angle. All hybrid golf clubs, in some examples presented herein, can have the same swing weight. These hybrid clubs, however, have shorter shafts as the loft angle increases so more head weight at the site is required to keep the same swing weight, which lowers the CG.

Figure 20:
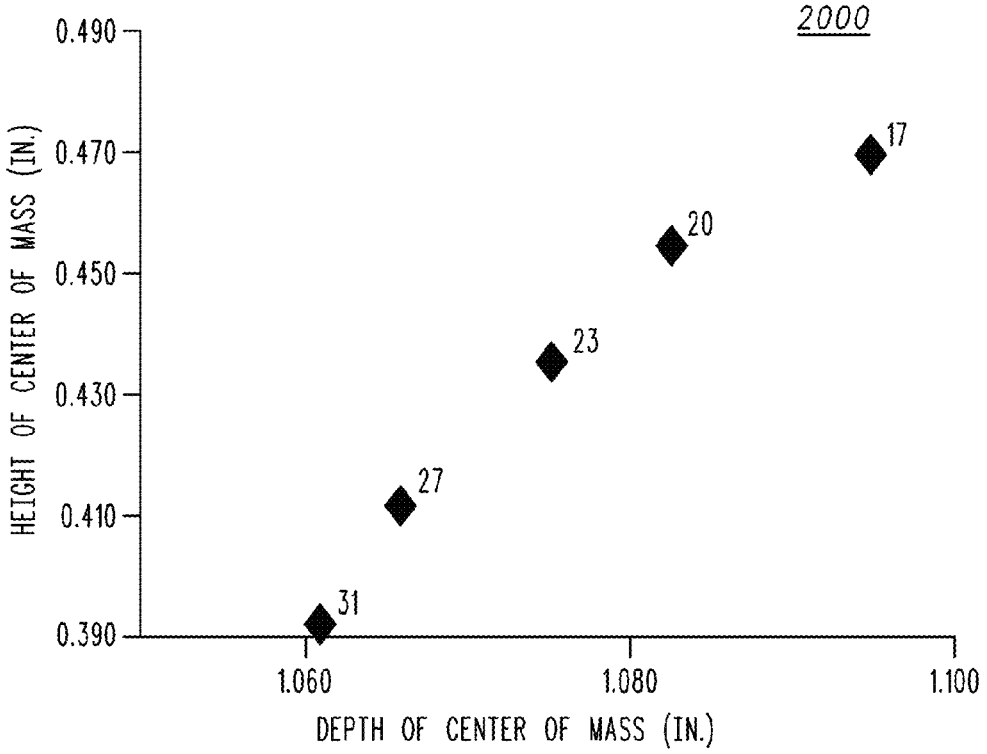
FIG. 20 illustrates a graph of an exemplary relationship between the weight position and the depth of center of mass of a golf club head, according to the second embodiment.

As indicated above in existing golf club heads, the CG will be lower and further back with an increase in loft because the "flattening" of the club face will be push the CG back and lower. However, in the embodiments shown in FIGS. 14-16, the CG of the club heads moves lower, but the CG also moves forward, as the loft increases. FIG. 20 illustrates a graph 2000 of an exemplary relationship between a depth of center of mass of a golf club head and a height of the center of mass, according to the second embodiment. In the examples shown in FIG. 20, as the loft angle increase the weight position (i.e., the depth of center of mass of a golf club head) decreases and the height of the CG decreases.

To achieve the CG progression outlined in FIGS. 17-20, the internal geometry can be changed, and the CG can be positioned lower and more forward towards the front face on the higher lofted clubs and further back from the front face on the lower lofted clubs. As shown in FIGS. 14-16, the lower lofted hybrids have the CG positioned further away from the front face while the higher lofted hybrids have a CG positioned closer the front face. This effectively moves the CG to a position that is more optimal for each club.

Changing the internal geometry of the mass is not the only technique that can be used to move the CG. In other examples, weights that are fixed to the sole of the golf club head (e.g., back sole weights 1411, 1511, and 1611 in FIGS. 14, 15, and 16 respectively) can be used to adjust the club head CG. For example, the weight of the golf club head may be manufactured to be less than the preferred weight, or the center of mass of the club may be not correct because of manufacturing variances. In these cases, the amount of weight in back sole weights 1411 (FIG. 14), 1511 (FIG. 15), and 1611 (FIG. 16) can be changed so the golf club head has the preferred weight and/or center of mass position. In the same or different examples, the CG between clubs in a set of clubs can be changed by removing material from the crown, adding material in the sole, and/or using materials with different densities.

Furthermore, while the CG of the golf clubs moves lower and forward as the loft angle increases, the face thickness (e.g., a thickness of first face portion 1440 (FIG. 14), second face portion 1540 (FIG. 15), and third face portion 1640 (FIG. 16)) can be kept at substantially the same thickness for a set of golf clubs. In the embodiments shown in FIGS. 14-16, the thickness profile of the strike face can vary internally within a particular strike face between approximately 0.070 inches and approximately 0.150 inches, but can be substantially consistent between the same portions of different strike faces of different clubs in the set of clubs (e.g., first face portion 1440 (FIG. 14), second face portion 1540 (FIG. 15), and third face portion 1640 (FIG. 16)). In other examples, the thickness profile of a particular strike face can be internally substantially consistent or constant. For example, the face thickness could be a constant approximately 0.090 inches throughout a particular strike face. In some examples, the face thickness in a set of golf clubs can increase or decrease by 0.002 inches between clubs with different loft angles. Keeping the thickness profile of the face portion relatively constant when changing loft angles, can help avoid face bending in the clubs and slower head speed when a golf ball is hit with the club.

Additionally, in many embodiments, a gap 1449 exists between the back edge of first face portion 1440 and a peak or an inflection point of distribution 1421, as shown in FIG. 14. Similarly, gaps 1549 and 1649 exists between the back edges of second face portions 1540 and 1640 and a peak or an inflection point of distributions 1524 and 1621, as shown in FIGS. 15 and 16, respectively. While the CG of the clubs moves lower and forwards as the loft angle increases, the gap between the back edge of face portion and a peak or an inflection point of the distribution can decrease and can vary from zero inches to two inches for hybrid-type golf clubs and from zero inches to 3.5 inches for fairway wood type golf clubs. In many embodiments, the gap can vary from zero inches to 0.8 inches for either hybrid-type golf clubs and/or fairway wood type golf clubs.

In some examples, the embodiments described herein can be advantageous for both higher lofted hybrids and lower lofted hybrids. Generally, lower lofted hybrids launch the ball with a flatter and lower trajectory. Conversely, higher lofted hybrids launch the ball with a larger and higher arc-like trajectory.

For the lower lofted hybrids, the CG will be placed relatively further back in the club head. Consequently the club head will experience more dynamic loft at impact. The increased dynamic loft at impact is due to the CG of the club head naturally aligning with the shaft axis running through the hands of the uses of the golf club. With the CG further back, the shaft bends forward to align the CG with the shaft axis, and the result is more loft ("dynamic loft") at impact. This additional dynamic loft can help launch the ball higher despite the club having less static loft.

For the higher lofted clubs, the CG will be closer to the face. By positioning the CG closer to the face, the "dynamic loft" referred to above will be minimized, and a lesser amount of delivered loft will be added at impact. Additionally, the closer CG will result in better energy transfer to the ball, which creates a more penetrating ball flight. With higher lofted clubs, in particular hybrids, the combination of loft and CG can lead to too high of a launch angle and too much spin, which adversely affects distance. Moving the CG forward decreases dynamic loft, which results in more optimal launch conditions. In various embodiments, the embodiments described herein can also be advantageous for fairway wood golf clubs for similar reasons.

Figure 21:
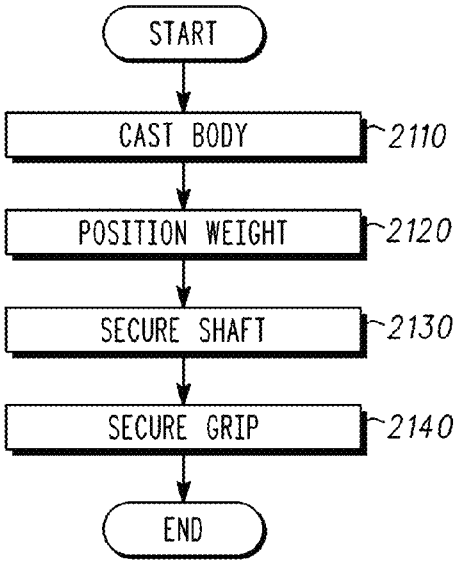
FIG. 21 is a flow diagram of one manner in which an example golf club can be manufactured.

FIG. 21 illustrates a flow chart for an embodiment of a method 2100 of manufacturing a golf club. Method 2100 is merely exemplary and is not limited to the embodiments presented herein. Method 2100 can be employed in many different embodiments or examples not specifically depicted or described herein. In some embodiments, the activities, the procedures, and/or the processes of method 2100 can be performed in the order presented. In other embodiments, the activities, the procedures, and/or the processes of method 2100 can be performed in any other suitable order. In still other embodiments, one or more of the activities, the procedures, and/or the processes in method 2100 can be combined or skipped.

In the example of FIG. 21, method 2100 can begin with an activity 2110 of casting the club head to form a golf club. In some examples, the club head can be similar or the same as golf club head 100, 1400, 1500, or 1600 of FIGS. 1, 14, 15, and 16, respectively. Method 2100 can continue with an activity 2120 of positioning a weight (e.g., the weight 710, 1410, 1510, and/or 1610 of FIGS. 7, 14, 15, and 16, respectively) at a distance relative to a front end plane based on the loft angle (e.g., loft angle 550, 1450, 1550, 1650 of FIGS. 5, 14, 15, and 16, respectively) in either a linear manner or a non-linear manner as described in relation to FIGS. 11-12 and 17-20. Further, the method 2100 can include an activity 2130 of securing a shaft (e.g., the shaft 198 of FIG. 1) to the club head as described above. Method 2100 can continue with an activity 2140 of securing a grip (e.g., the grip 199 of FIG. 1) to the shaft.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that activities 2110, 2120, 2130, and 2140 of FIG. 21 may be comprised of many different activities, procedures and be performed in many different orders, and that any element of FIGS. 1-21 may be modified and that the foregoing discussion of certain of these embodiments does not necessarily represent a complete description of all possible embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A set of golf clubs comprising:

a first club having a first club head, the first club head comprising: a first toe end, a first heel end, a first front end, a first back end, a first top wall portion, a first bottom wall portion, a first face portion associated with a first loft angle defined by a first loft plane and a first front end plane, the first front end plane is perpendicular to a first ground plane, and a first weight, at least a portion of the first weight positioned along a first axis extending between the first front end and the first back end; and a second club having a second club head, the second club head comprising: a second toe end, a second heel end, a second front end, a second back end, a second top wall portion, a second bottom wall portion, a second face portion associated with a second loft angle defined by a second loft plane and a second front end plane, the second front end plane is perpendicular to the first ground plane, and a second weight, at least a portion of the second weight positioned along a second axis extending between the second front end and the second back end, wherein:

the first face portion comprises:

a first region comprising a first thickness profile; and a second region comprises a second thickness profile;

the second face portion comprises:

a first region comprising a first thickness profile; and a second region comprising a second thickness profile;

a first center of mass of the first club head is positioned at or proximate to a first distance relative to the first front end plane;

a second center of mass of the second club head is positioned at or proximate to a second distance relative to the second front end plane;

a first height is defined as a third distance between the first center of mass of the first club head and the first bottom wall portion of the first club head;

a second height is defined as a fourth distance between the second center of mass of the second club head and the second bottom wall portion of the second club head;

the first thickness profile of the first region of the first face portion is different than the second thickness profile of the second region of the first face portion;

the first thickness profile of the first region of the second face portion is different than the second thickness profile of the second region of the second face portion;

the first thickness profile of the first region of the first face portion is substantially equal to the first thickness profile of the first region of the second face portion;

the second thickness profile of the second region of the first face portion is substantially equal to the second thickness profile of the second region of the second face portion;

the first loft angle is greater than the second loft angle;

the second loft angle is greater than 15 degrees;

the first distance is less than the second distance;

the first height is less than the second height; and the first distance is defined by a first equation of $((-0.0024*\theta)+1.28)\geq x\geq((+0.0024*\theta)+0.98)$, where the first distance, x, has units of inches and the first loft angle, θ, has units of degrees.

2. The set of golf clubs of claim 1, wherein:

the first distance is inversely proportional to the first loft angle in a linear manner; and the second distance is inversely proportional to the second loft angle in the linear manner.

3. The set of golf clubs of claim 1, wherein:

the first loft plane, the first front end plane, and the first ground plane intersect at a common point; and the first distance is measured from the common point into the club head.

4. The set of golf clubs of claim 1, wherein:

the first height is inversely proportional to the first loft angle.

5. The set of golf clubs of claim 1, wherein:

the first height is inversely proportional to the first loft angle; and the second height is inversely proportional to the second loft angle.

6. The set of golf clubs of claim 1, wherein:

the first distance is defined by a second equation of $((-0.0024*\theta)+1.23)\geq x\geq((-0.0024*\theta)+1.03)$, where the first distance, x, has units of inches and the first loft angle, θ, has units of degrees.

7. The set of golf clubs of claim 1, wherein:

the first distance is defined by a second equation of $y = (-0.0024*\theta)+1.13$, where the first distance, x, has units of inches and the first loft angle, θ, has units of degrees.

8. The set of golf clubs of claim 1, wherein:

the first bottom wall portion comprises a first gap between the first face portion and a first inflection point of distribution at the first bottom wall portion; and the second bottom wall portion comprises a second gap at the second face portion and a second inflection point of distribution at the second bottom wall portion.

* * * * *